US006292645B1

(12) United States Patent
Yu

(10) Patent No.: US 6,292,645 B1
(45) Date of Patent: Sep. 18, 2001

(54) APPARATUS AND METHOD FOR MINIMIZING THE HALO EFFECT IN AN ELECTROSTATOGRAPHIC PRINTING SYSTEM

(75) Inventor: Zhao-zhi Yu, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/678,204

(22) Filed: Oct. 3, 2000

(51) Int. Cl.[7] ..... G03G 15/08

(52) U.S. Cl. ..... 399/285; 399/265; 399/269; 430/120

(58) Field of Search ..... 399/53, 55, 270, 399/285, 265, 269, 240; 430/120

(56) References Cited

U.S. PATENT DOCUMENTS 4,266,868 5/1981 Bresina et al. ..... 399/269
4,267,797 * 5/1981 Huggins ..... 399/269
4,771,314 * 9/1988 Parker et al. ..... 399/55 X
5,032,872 7/1991 Folkins et al. ..... 399/266
5,911,098 * 6/1999 Gyotoku et al. ..... 399/269 X
6,167,228 * 12/2000 German et al. ..... 399/269 X

FOREIGN PATENT DOCUMENTS 07-295369 * 11/1995 (JP) .

* cited by examiner

*Primary Examiner*—Sophia S. Chen
(74) *Attorney, Agent, or Firm*—Linda M. Robb

(57) ABSTRACT

A multicolor imaging apparatus utilizes a recording medium adapted to having a plurality of latent electrostatographic images defined by image charge potential areas and background charge potential areas. The recording medium moves in a process direction such that an image is recorded on the recording medium and then developed at a plurality of development stations. At least one of the development stations includes not less than two development housings, with each such housing including at least one donor roll, which is electrically biased.

9 Claims, 3 Drawing Sheets

FIG. 2
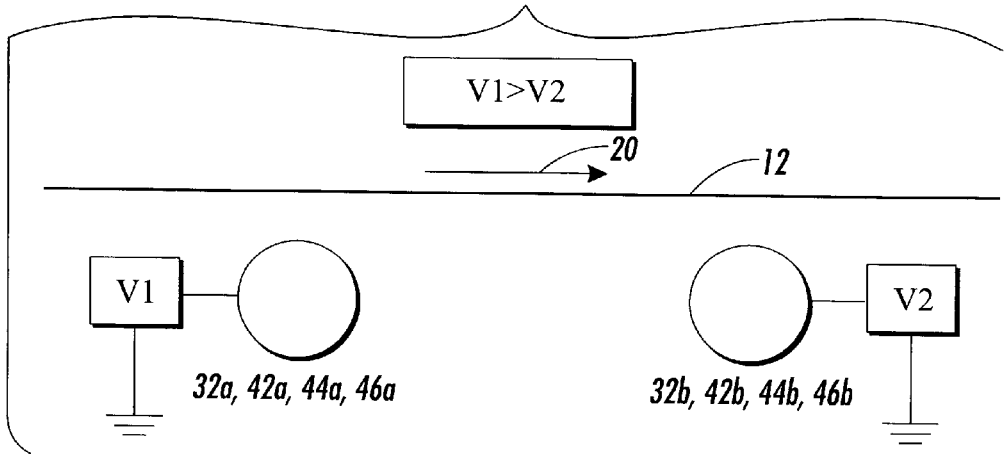
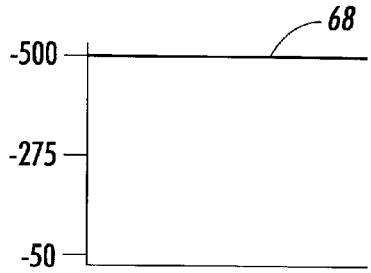
FIG. 3
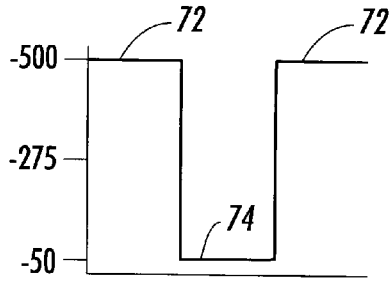
FIG. 4

APPARATUS AND METHOD FOR MINIMIZING THE HALO EFFECT IN AN ELECTROSTATOGRAPHIC PRINTING SYSTEM

BACKGROUND OF THE INVENTION

This invention relates to electrophotographic-printing machines and more particularly to a split development system, wherein bias voltages are applied to the development rolls.

Electrophotographic marking is a well-known and commonly used method of copying or printing documents. Electrophotographic marking is performed by exposing a light image representation of a desired document onto a substantially uniformly charged photoreceptive member. In response to exposure by the light image representation, the photoreceptive member discharges so as to create an electrostatic latent image of the desired document on the surface of the photoreceptive member. A development material having toner is then deposited onto the electrostatic latent image so as to form a toner image. That toner image is then transferred from the photoreceptor onto a substrate, such as a sheet of paper. The transferred toner image is then fused to the substrate to form the completed document. Fusing of the toner image to the substrate is typically accomplished by a combination of heat and/or pressure. The surface of the photoreceptive member is then cleaned of residual developing material and recharged in preparation for the production of another document.

Multicolor images by electrophotographic marking can be produced by repeating the above described process once for each color of toner that is employed to form the composite toner image. For example, in one color process referred to herein as the REaD process (recharge expose and develop), a charged photoreceptive surface is exposed to a light image which represents the first component color of a composite color image. The composite color image is produced from a composite toner image of four layers of toner, the first typically being black, followed by magenta, yellow, and cyan. The resulting first electrostatic latent image is then developed with black toner particles to produce the black toner layer for the composite toner image. The charge, expose and develop process is then repeated to form a toner layer of the second component color of the composite color image. In an image-on-image process color (IOI), the subsequent component toner layers may overlay the previous component toner layers to thereby form a full spectrum of colors by their interaction. Alternately, the process can involve image-next-to-image (INI) wherein the component toner layers are positioned adjacent each other. Image-next-to-image is typically employed, for example, in highlight color printing. The INI process, typically has two color toners wherein one component color is the highlight on the document. However, the INI process can clearly be implemented with additional color toners. In the IOI process, the color toner particles of the component toner layers are placed in a superimposed registration so that the desired composite color images are formed. The composite toner image in either the REaD 101 process or REaD INI process is then transferred from the photoreceptive member and onto the substrate.

The REaD IOI and REaD INI processes can be implemented in a variety of configurations of an electrophotographic printing machine. In a single pass printing arrangement, the final composite toner image is produced in a single pass of the photoreceptive member through a printing machine having multiple charging development and exposure stations. Typically, four charging stations and four exposure stations are implemented to recharge, expose and develop each component color toner layer of the desired final four color composite toner image. Alternately in a multiple pass arrangement, the photoreceptive member cycles past a single charging station, a single exposure station, and multiple development stations. The photoreceptive member typically will cycle four times, one cycle for each component toner layer. In either configuration of an electrophotographic-printing machine, the composite toner image its subsequently transferred from the photoreceptive member to the substrate in a single step. The transfer can be directly to the substrate or via an intermediate toner support member such as a belt or drum.

Background print quality defects can be a serious problem with any color print architecture. One such defect is a halo effect, in which a white edge surrounds a toned area. The halo effect occurs when fringe fields, caused by surface potential differences, are generated at the edge of a toned area. The fringe field pulls charged toner particles away from the edges of the area to receive toner, resulting in a white untoned edge surrounding a toned area. In the case of a monochrome process, the white edge surrounding the toned area is not visible, because the background area is white. In the case of a multicolor process, with one color area surrounded by another color, the white edge is visible.

The following disclosures may be relevant and/or helpful in providing an understanding of some aspect of the present invention:

U.S. Pat. No. 5,032,872 to Folkins et al. discloses a developer apparatus including a reservoir for storing a supply of developer material, and a magnetic brush roll for transporting material from the reservoir to each of two donor rolls in a single housing.

U.S. Pat. No. 4,266,868 to Bresina et al. discloses a development apparatus wherein a magnetic brush roller delivers a single component developer directly from a reservoir to a photoconductive surface and also transfers the developer from the reservoir to a second magnetic brush roller.

SUMMARY OF THE INVENTION

A multicolor imaging apparatus utilizes a recording medium adapted to having a plurality of latent electrostatographic images defined by image charge potential areas and background charge potential areas. The recording medium moves in a process direction such that an image is recorded on the recording medium and then developed at a plurality of development stations. At least one of the development stations comprises not less than two development housings, with each such housing including at least one donor roll, which is electrically biased.

A method for producing a multicolor output image from an input image signal includes providing a recording medium for recording latent electrostatographic images, defined by image charge potential areas and background charge potential areas. The electrostatographic latent image is developed with a plurality of development stations, in which at least one development station includes not less than two development housings. Each development housing includes at least one donor roll electrically biased to a potential less than the background charge potential areas of the recording medium.

A multicolor imaging apparatus utilizes a recording medium adapted to having a plurality of latent electrostatographic images defined by image charge potential areas and background charge potential areas. The recording medium moves in a process direction such that an image is recorded on the recording medium and then developed at a plurality of development stations. At least one of the development stations comprises not less than two donor rolls, which are electrically biased.

BRIEF DESCRIPTION OF THE DRAWINGS

FIG. 2 is a schematic view of the split development roll according to an embodiment of the instant invention;

FIG. 3 shows the photoreceptor voltage profile after uniform charging;

FIG. 4 shows the photoreceptor voltage profile after a first DAD exposure step;

DETAILED DESCRIPTION OF THE INVENTION

This invention relates to an imaging system, which is used to produce an image on image or image next to image color output in a single or multiple revolutions or passes of a photoreceptor belt with either Discharged Area Development (DAD) or Charged Area Development (CAD). It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system, and a single or multiple pass highlight color system.

Figure 1:
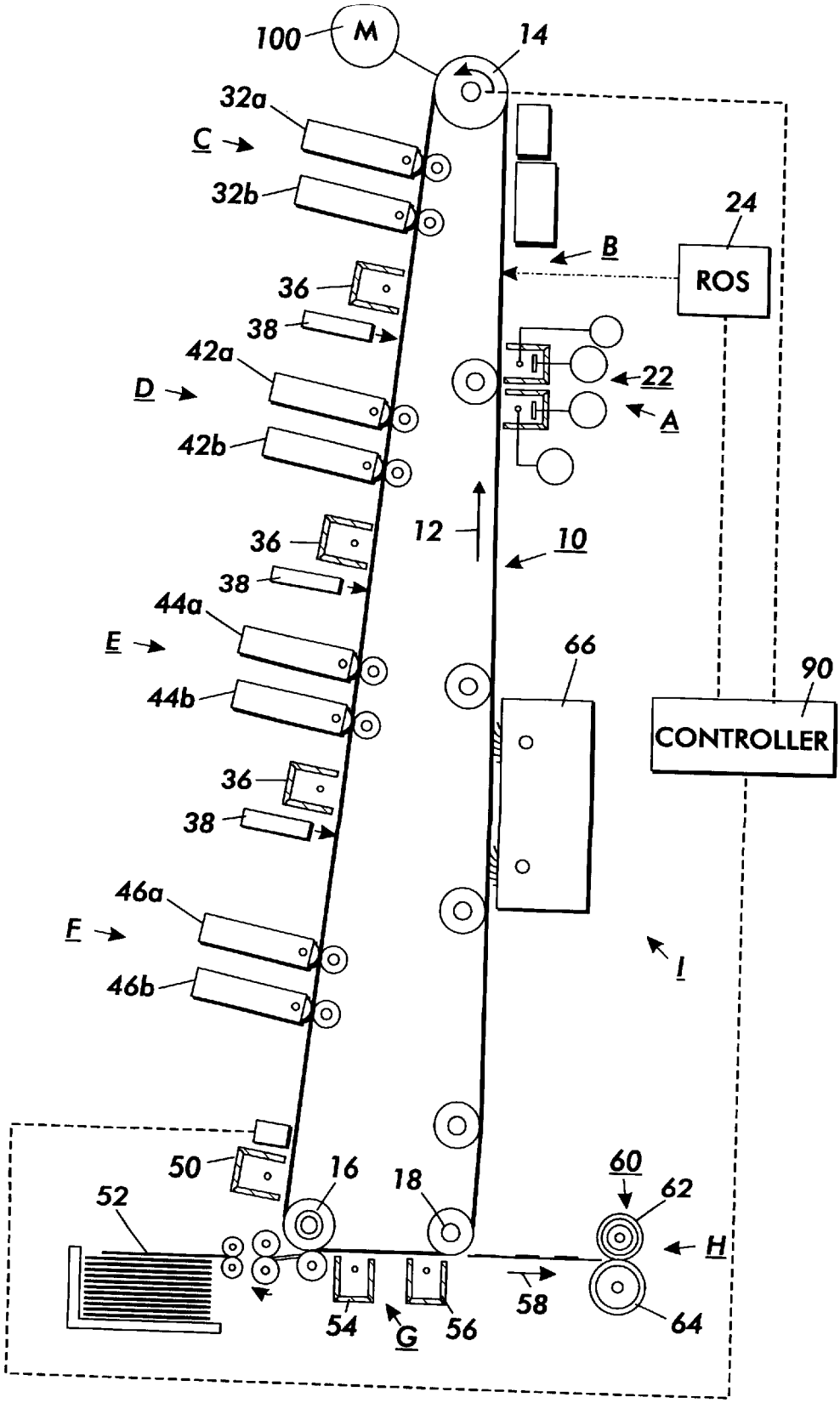
FIG. 1 is a schematic illustration of an imaging apparatus incorporating the development system features of the invention.

Turning now to FIG. 1, the electrophotographic printing machine of the present invention uses a charge retentive surface in the form of a photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 100 for effecting movement of the belt through the xerographic stations.

With continued reference to FIG. 1, a portion of belt 10 passes through charging station A where a corona generating device, indicated generally by the reference numeral 22, charges the photoconductive surface of belt to a relatively high, substantially uniform, preferably negative potential.

Next, the charged portion of the photoconductive surface is advanced through an imaging station B. At exposure station B, the uniformly charged belt 10 is exposed to an illumination device 24 which causes the charge retentive surface to be discharged in accordance with the output from the scanning device. Preferably the scanning device is a laser Raster Output Scanner (ROS). Alternatively, the ROS could be replaced by other xerographic exposure devices.

The photoreceptor, which is initially charged to a voltage $V_0$, undergoes dark decay to a level $V_{ddp}$ equal to about −500 volts. when exposed at the exposure station B it is discharged to $V_{image}$ equal to about −50 volts. Thus after exposure, the photoreceptor contains a monopolar voltage profile of high and low voltages, the former corresponding to charged areas and the latter corresponding to discharged or image areas.

The photoreceptor is then moved again in the process direction to the group of first, second, third and fourth developer stations C, D, E and F, which will be described hereinafter in greater detail with reference to FIGS. 2 through 8. The first, second, third and fourth developer stations C, D, E and F preferably correspond to the four basic color components, black, yellow, magenta, and cyan, that are employed to form a complete full range color composite toner image.

In the case of DAD, at a first development stan C, a donor roll advances developer material into contact with the electrostatic latent image. The donor roll presents, for example, negatively charged black toner material to the discharged image areas for development thereof. Appropriate developer biasing is accomplished via a power supply (not shown). Electrical biasing is such as to effect discharged area development or charged area development of the image area oil the photoreceptor with the developer material.

A voltage sensitive corona recharge device 36 is employed for raising the voltage level of both the toned and untoned areas on the photoreceptor to a substantially uniform level. The corona recharge device 36 serves to substantially eliminate any voltage difference between toned areas and bare untoned areas, so that subsequent imaging and development of different color toner images is effected across a uniformly charged surface of both the previously developed toner layer(s) and the bare untoned areas of the photoreceptor.

A post development erase device (not shown) disposed adjacent the backside of the belt 10, may be used in conjunction with the recharge step to reduce the charge level of the photoreceptor in the untoned or developed areas. Such a post development erase step may be performed using a corona device or an exposure device.

A second exposure or imaging device 38 which may comprise a laser based output structure is utilized for selectively discharging the photoreceptor on toned areas and/or bare areas, pursuant to the image to be developed with the second color developer. After this point, the photoreceptor contains toned and untoned areas at relatively high voltage levels and toned and untoned areas at relatively low voltage levels. These low voltage areas represent image areas, which will be developed using discharged area development (DAD). To this end, a negatively charged, developer material comprising color toner is employed. The toner, which by way of example may be yellow, is contained in a developer housing structure 42*a* and 42*b* disposed at a second developer station D and is presented to the latent images on the photoreceptor by a non-interactive developer. A power supply (not shown) serves to electrically bias the developer structure to a level effective to develop the DAD image areas with negatively charged yellow toner particles.

A corona recharge device 36 serves to condition both the toned and untoned areas of the photoreceptor, by recharging both these areas of the photoreceptor to a predetermined uniform level and reducing the residual toner voltage across the previously developed toned layer(s). The photoreceptor is then at a substantially uniform potential between bare areas and toned areas, in preparation for the creation of the third color image.

A pre-recharge corona device (not shown) may be used in conjunction with a recharge device, to condition the voltages representative of DAD developed images and background areas of the photoreceptor.

A third latent image is created using an imaging or exposure member 38. In this instance, a second DAD image is formed, discharging both bare areas of the photoreceptor and toned areas of the photoreceptor that will be developed with the third color image. This image is developed using a third color toner, such as magenta. Suitable electrical biasing of the housings 44*a* and 44*b* is provided by a power supply, not shown.

A corona recharge device 36 serves to recharge the photoreceptor and minimize the voltage differential between the previous toned layer(s) and the photoreceptor, so that the photoreceptor is at a substantially uniform potential between bare areas and toned areas, in preparation for the creation of the fourth color image.

A fourth latent image is created using an imaging or exposure member 38. A third DAD image is formed on both bare areas and previously toned areas of the photoreceptor that are to be developed with the fourth color image. This image is developed using a fourth color toner, such as cyan. Suitable electrical biasing of the housing 46 is provided by a power supply, not shown.

The developer housing structures 32*a,* 32*b,* 42*a,* 42*b,* 44*a,* 44*b,* 46*a,* and 46*b* are preferably of the type known in the art which do not interact, or are only marginally interactive with previously developed images, for example, a non-interactive, scavengeless development housing having minimal interactive effects between previously deposited toner and subsequently presented toner. A pre-transfer corotron member 50 may be needed to condition the toner for effective transfer to a substrate using positive corona discharge.

Subsequent to image development, a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer corona current source 54, which sprays positive ions onto the backside of sheet 52. This attracts the negatively charged toner powder images from the belt 10 to sheet 52. A detack corona current source 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from the photoconductive surface of belt 10, the residual toner particles on the photoconductive surface are removed therefrom. These particles are removed at cleaning station I using a cleaning brush structure contained in a housing 66.

The various machine functions described hereinabove are generally managed and regulated by a controller 90, preferably in the form of a programmable microprocessor. The microprocessor controller 90 provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

As previously noted, a significant problem which exists in electrostatographic systems is a halo created around toner areas due to the generation of fringe fields caused by surface potential differences at the edges. These fringe fields pull charged toner particles away from the edges of a toned area, leaving a white untoned edge surrounding the toned area. Research has shown that the final fringe is a function of two surface voltages: background voltage to which the charged photoreceptive surface has been decaying without illumination and the neutralization voltage, the voltage present on the toned areas of the photoreceptive surface at the end of the development process. The closer the neutralization voltage is to the background voltage, the smaller the fringe field will be, thus minimizing the halo effect.

The present invention contemplates a process and apparatus for preventing a halo effect by applying a split development bias voltage to each individual development station present in the multi-color printing system. In its simplest form, the concept of the present invention is directed toward applying a different predetermined bias to each developer roll or housing in the split development stations illustrated in FIG. 1. Each development station C, D, E and F is comprised of two developer housings or rolls. As illustrated in FIG. 2, each of the first developer housings or rolls 32*a,* 42*a,* 44*a,* and 46*a* of corresponding developer stations C, D, E and F are biased to a first voltage V1 by a voltage source. The voltage V1 applied in this first development step is higher than the bias applied in prior art development processes. This higher bias results in a lower voltage differential between the background area surface potential and the donor roll bias (the cleaning field), producing a higher development field and also a higher neutralization voltage than generally seen in these processes. This arrangement of voltage provides a minimum cleaning field, which effectively prevents toner particle deposition to background areas of the image.

Each of the second developer housing or rolls 32*b,* 42*b,* 44*b,* and 46*b* of developer stations C, D, E and F are biased to a lower second voltage V2. The function of the second roll or housing is principally to deposit toner particles into the edges of the toned area, thus minimizing the halo effect.

The concept of the present invention will now be described in terms of exemplary bias voltages applied to each development station. It will be understood that in a basic development subsystem, the toner particles in the developing material obey the basic rule that the force on the toner particles is equal to the product of the charge and the electrical field, such that toner particles are attracted to the photoreceptive surface only when the electrostatic forces acting on the particles is greater than zero. In a typical electrostatographic printing system, a voltage bias, which lies in between the background area surface potential and the image area surface potential, is applied to a developer system so that the electric field between the image area and the development roll attracts the toner from the developer housing to the image area. This practice is also utilized to prevent toner from developing to non-image or background areas of the recording medium with an opposite field. Thus, a bias voltage is generally applied to a development system in order not only to fulfill image area development, but also to prevent background area development. The proposed utilization of a split bias development system can be employed to minimize the appearance of a halo effect.

The voltage profiles on the photoreceptor 10 depicting the image forming process steps are illustrated in FIGS. 3 through 8. FIG. 3 illustrates the voltage profile 68 on the photoreceptor belt after the belt has been uniformly charged. The photoreceptor is initially charged to a voltage slightly higher than the −500 volts indicated but after dark decay the voltage level is −500 volts. After a first exposure at exposure station B, the voltage profile comprises high and low voltage levels 72 and 74, respectively, as illustrated in FIG. 4. The level 74 at −50 volts represents the DAD image area to be developed by the black developer housing 26 while the level 72 at −500 volts represents the area discharged by the laser 24 and corresponds to the background, which should not accept any toner.

Figure 5:
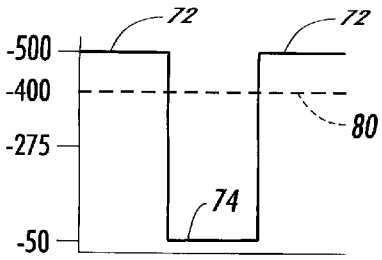
FIG. 5 shows the photoreceptor voltage profile after an electrical bias is applied to the donor roll of the first split developer housing in a development station in accordance with the present invention.
Figure 6:
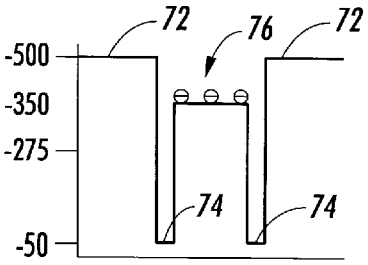
FIG. 6 shows the photoreceptor voltage profile after toner is deposited on the photoreceptor belt at the first split developer housing of a development station in accordance with the present invention.
Figure 7:
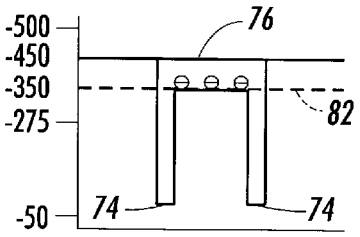
FIG. 7 shows the photoreceptor voltage profile after an electrical bias is applied to the donor roll of the second split developer housing in a development station in accordance with the present invention.
Figure 8:
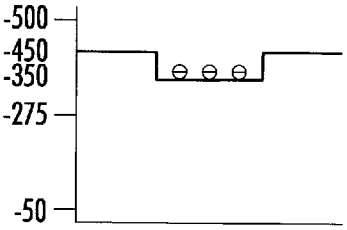
FIG. 8 shows the photoreceptor voltage profile after toner is deposited on the photoreceptor belt at the second split developer housing in a development station in accordance with the present invention.

At first development station C, the donor roll of the first development housing 32*a* is biased to $V_{bias1}$ 80 equal to about −400 volts, or approximately 15% to 25% of the first background voltage potential, resulting in a development field differential (potential difference) of 350 volts, and a minimum cleaning field of approximately 100 volts at first development housing 32*a,* as illustrated in FIG. 5. The donor roll then brings toner material into contact with the electrostatic latent image present on the photoreceptive member. As described above and as illustrated in FIG. 6, the higher neutralization voltage 76 here approaches approximately −350 to −450 volts. Toner particles are deposited to the image and toner deposition to the background areas is prevented. At second development housing 32*b,* the background area surface potential decays lower to $V_{ddp2}$ of about −450 volts and the bias 82 applied at the donor roll is about −350 volts, or approximately 15% to 25% of the second background voltage potential, with $V_{exp}$ 74 remaining at −50 volts, as illustrated in FIG. 7. The resulting development field differential at the second housing approaches −300 volts, which corresponds to the development field electrostatographic machines known to the art. Now, with a background potential of about −450 volts, and −350 to −400 volts on the main part of the toned image area, the fringe field at the edge of the image area is much smaller than in the case of the previous development housing. When the second donor roll brings toner material into contact with the electrostatic latent image, toner particles are thus deposited into the edges of the toned area, minimizing the halo effect, as illustrated in FIG. 8.

The image area is then moved in the process direction past the recharge and exposure steps, which bring the voltage levels on the photoreceptor surface to the levels illustrated in FIGS. 3 and 4. The photoreceptor then moves the image to the second development station D and first development housing 42*a* for the deposition of toner particles in accordance with the steps described above and at the voltage profiles illustrated in FIGS. 5 and 6. Toner is then deposited on the photoreceptor at the second developer housing 42*b* in accordance with the steps described above and at the voltage profiles illustrated in FIGS. 7 and 8. This process is then repeated for the third and fourth developer stations E and F.

It is, therefore, apparent that there has been provided, in accordance with the present invention, a method and apparatus for minimizing the halo effect in a multi-color electrostatographic system, and, more particularly, and image-on-image multicolor system, wherein split development biases for each color in the printing process is applied so as to minimize voltage differentials which can operate to pull toner particles from the edge of an imaged area. This apparatus fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An electrostatographic printing machine for producing a multicolor output image from an input image signal, comprising:

a recording medium adapted to have a plurality of latent electrostatographic images recorded thereon, defined by image charge potential areas and background charge potential areas, moving in a process direction such that an image is recorded on said recording medium and then developed thereon;

at least one imaging device for generating an electrostatic latent image on said recording medium;

a plurality of development stations for developing the electrostatic latent image on said recording medium with developing materials to produce a developed image thereon, at least one development station comprising not less than two development housings, wherein each development housing includes at least one donor roll, wherein said donor roll in the first one of said development housings positioned in the process direction following said imaging device receives a bias potential higher than the said donor roll in the second of said development housings, said bias potential ranging from about 15% to about 25% less than a first background charge potential voltage; and means for applying bias potentials to each said donor roll in said development housing.

2. The development stations according to claim 1, wherein each said development station comprises two development housings.

3. The development stations according to claim 1, wherein said bias potential received by said donor roll in said second development housing ranges from about 15% to about 25% less than a second background charge potential voltage.

4. A method for producing a multicolor output image from an input image signal, comprising:

providing a recording medium adapted to have a plurality of latent electrostatographic images recorded thereon, defined by image charge potential areas and background charge potential areas and moving in a process direction such that an image is recorded on said recording medium and then developed thereon;

generating an electrostatic latent image on said recording medium with an imaging device;

developing the electrostatic latent image on said recording medium with a plurality of development stations, at least one said development station comprising not less than two development housings, wherein each development housing includes at least one donor roll; and biasing each said donor roll in said development housing electrically to potentials less than the background charge potential areas of said recording medium, wherein biasing said donor rolls further includes biasing said donor roll in a first one of said development housings positioned in the process direction following said imaging device to a bias potential higher than the bias potential applied to the said donor roll in the second one of said development housings, and wherein said bias potential received by said donor roll in said first development housing is at least 15% less than a first background charge potential voltage.

5. The method according to claim 4, wherein each said development station comprises two said development housings.

6. The method according to claim 4, wherein said bias potential received by said donor roll in said first development housing is not greater than 25% less than said first background charge potential voltage.

7. An electrostatographic printing machine for producing a multicolor output image from an input image signal, comprising:

a recording medium adapted to have a plurality of latent electrostatographic images recorded thereon, defined by image charge potential areas and background charge potential areas, moving in a process direction such that in image is recorded on said recording medium and then developed thereon;

at least one imaging device for generating an electrostatic latent image on said recording medium;

a plurality of development stations for developing the electrostatic latent image on said recording medium with developing materials to produce a developed image thereon, at least one station comprising not less than two development housings, wherein each development housing includes at least one donor roll, wherein said donor roll in the first one of said development housings positioned in the process direction following said imaging device receives a bias potential higher than the said donor roll in the second of said development housings, said bias potential ranging from about 15% to about 25% less than a first background charge potential voltage; and means for applying bias potentials to each said donor roll in said development station.

8. The development stations according to claim 7, wherein said two donor rolls comprise a first and a second donor roll.

9. The donor rolls according to claim 7, wherein said bias potential received by said second donor roll preferably ranges from about 15% to about 25% less than a second background charge potential voltage.

* * * * *